US007625169B2

(12) United States Patent
Manzoori

(10) Patent No.: US 7,625,169 B2
(45) Date of Patent: Dec. 1, 2009

(54) VARIABLE DISPLACEMENT TURBINE LINER

(75) Inventor: Reza Manzoori, Derby (GB)

(73) Assignee: Rolls-Royce PLC, London (GB)

( * ) Notice: Subject to any disclaimer, the term of this patent is extended or adjusted under 35 U.S.C. 154(b) by 604 days.

(21) Appl. No.: 11/447,023

(22) Filed: Jun. 6, 2006

(65) Prior Publication Data

US 2007/0003411 A1 Jan. 4, 2007

(30) Foreign Application Priority Data

Jul. 2, 2005 (GB) ..... 0513654.4

(51) Int. Cl.
*F01D 11/16* (2006.01)

(52) U.S. Cl. ..... 415/14; 415/173.1; 415/173.2

(58) Field of Classification Search ..... 415/14, 415/126, 128, 173.1–173.3
See application file for complete search history.

(56) References Cited

U.S. PATENT DOCUMENTS 4,330,234 A * 5/1982 Colley ..... 415/173.2
5,035,573 A 7/1991 Tseng et al.
5,049,033 A * 9/1991 Corsmeier et al. ..... 415/173.2
5,096,375 A 3/1992 Ciokailo
5,104,287 A * 4/1992 Ciokajlo ..... 415/173.2
7,079,957 B2 * 7/2006 Finnigan et al. ..... 415/173.2

FOREIGN PATENT DOCUMENTS

GB 1 341 834 12/1973
GB 2 108 591 A 5/1983

* cited by examiner

*Primary Examiner*—Christopher Verdier
(74) *Attorney, Agent, or Firm*—Oliff & Berridge, PLC

(57) ABSTRACT

A turbine stage of a gas turbine engine is surrounded by a ring of liner segments. The liner segments can be moved radially in unison towards and away from the tips or fins of blades, by rotation of a connected unison ring, so as to avoid blade fin rub. Alternatively, the segments can be moved in a common direction by bodily movement of the connected unison ring so as to avoid blade fin rub during off axis rotation of the turbine stage.

8 Claims, 3 Drawing Sheets

VARIABLE DISPLACEMENT TURBINE LINER

BACKGROUND

The present invention relates to an assembly including a casing that supports a liner constructed from a plurality of arcuate segments, which segments, when in situ, surround a stage of turbine blades in close spaced relationship therewith. The segments are moveable relative to the blades, so as to cater for variations in blade length due to operating stresses.

It is known to provide a casing structure supporting a segmented liner about a stage of turbine blades, and, when rotational operation of the stage of blades in an associated gas turbine engine causes them to extend e.g. when the gas turbine engine is accelerated to full power, to then heat the casing structure so as to expand it and thus lift the segments away from the blades tips. Further, when engine power is reduced, which results in contraction of the turbine blades, it is known to cool the casing structure in order to cause it to also contract, in an attempt to maintain a desired clearance between the liner segments and the blades tips.

SUMMARY

It has proved impossible to accurately match the expansion and contraction rates of the casing structure with the expansion and contraction rates of the turbine blades.

The present invention seeks to provide an improved casing structure and segmented liner assembly.

According to the exemplary embodiments, a segmented turbine liner supported by and within turbine casing structure includes sensing means with which to sense the proximity of said segments to turbine blades tips during operational rotation of a stage of said blades within said casing, signal generating means connected to said sensing means, and segment moving means connected to receive and be activated by signals generated thereby, so as to move as appropriate, any segments that said signals indicate are incorrectly spaced from respective blade tips.

BRIEF DESCRIPTION OF THE DRAWINGS

The exemplary embodiments of the invention will now be described, by way of example, and with reference to the accompanying drawings, in which.

DETAILED DESCRIPTION OF EMBODIMENTS

Figure 1:
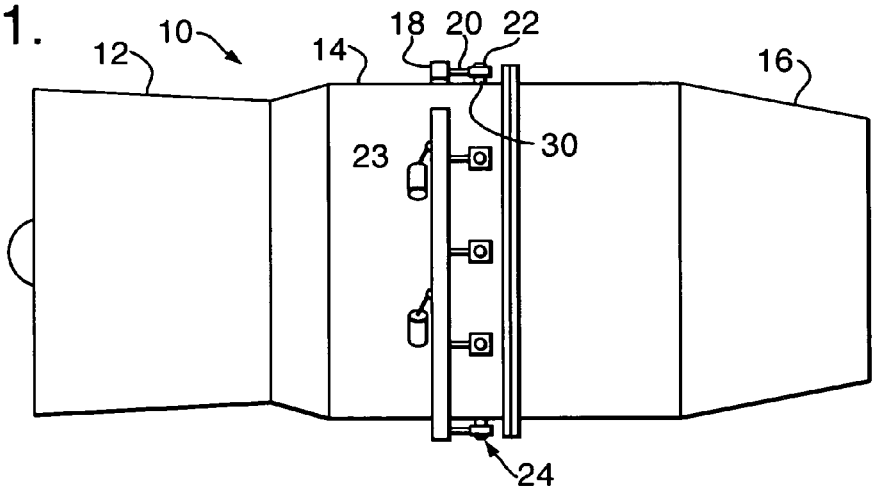
FIG. 1 is a diagrammatic sketch of a gas turbine engine incorporating movable liner segments in accordance with an exemplary embodiment.

Referring to FIG. 1. A gas turbine engine 10 includes a compressor 12, an outer casing 14 containing combustion equipment, followed by a turbine stage, (neither being shown in FIG. 1), and terminating in exhaust ducting 16. A unison ring 18 surrounds casing 14 and is connected via ball joints 19, and links 20 to respective ones of a corresponding number of screw threaded rods 22, that are equi-angularly spaced around casing 14. Links 20 are keyed to respective outer ends

24 of rods 22, so as to prevent relative rotation therebetween. Push-pull rams 23 rotate unison ring 18 on command, as explained later herein.

Figure 2:
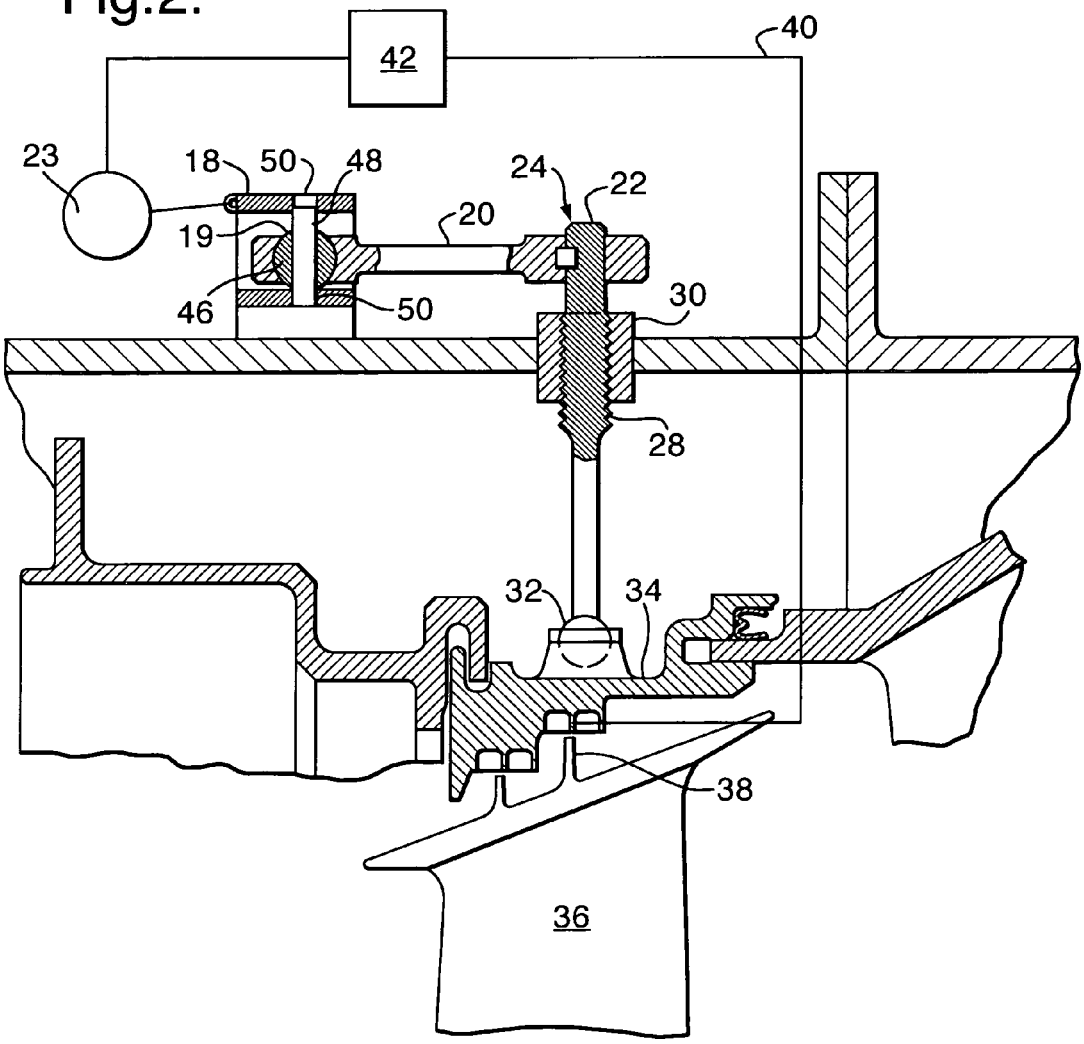
FIG. 2 is a cross sectional axial part view through the turbine section of the gas turbine engine of FIG. 1 and depicts means to achieve common movement of the segments.
Figure 4:
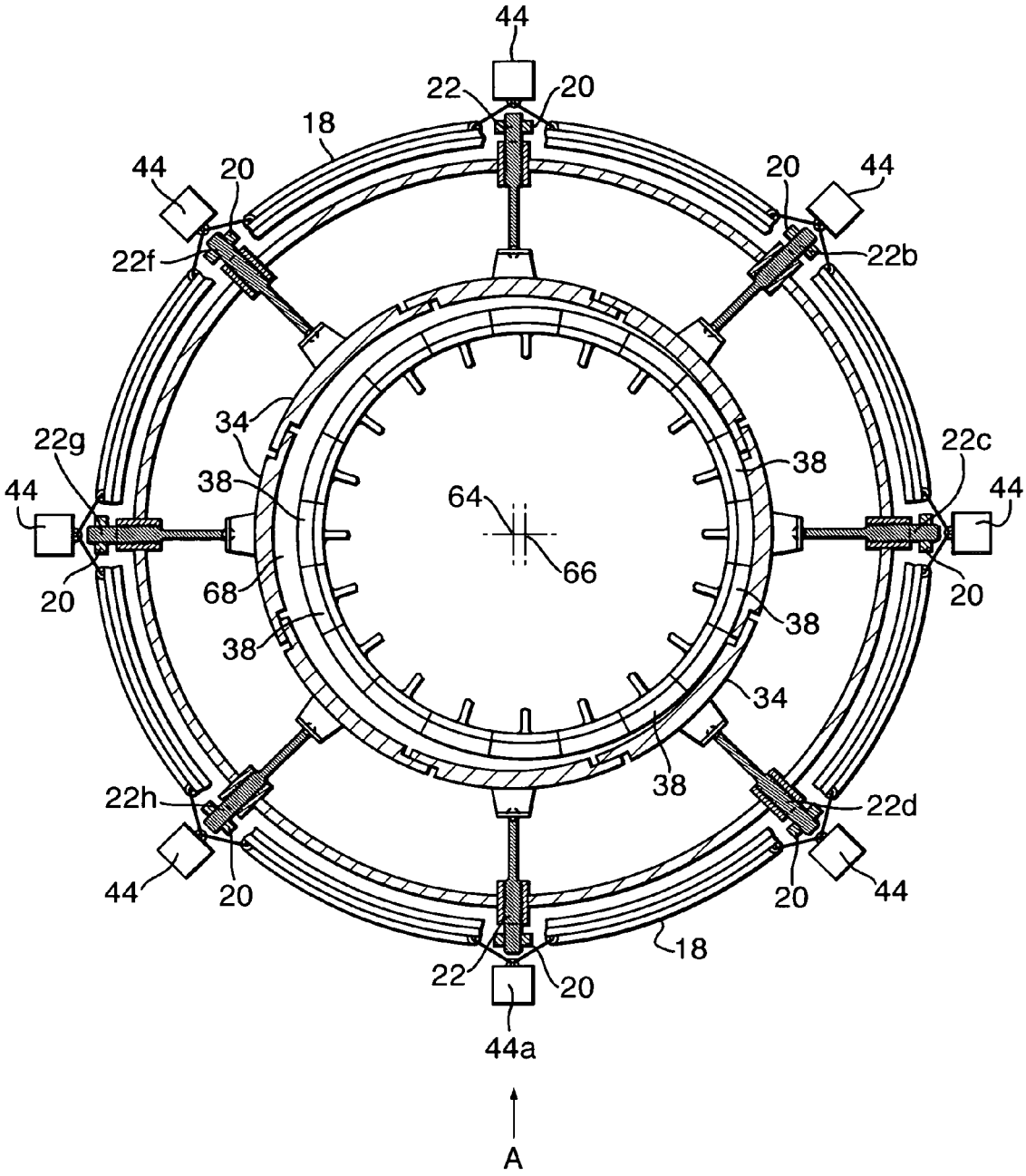
FIG. 4 is a cross sectional view on line 4-4 in FIG. 3.

Referring to FIG. 2. The screw threaded portions 28 of rods 22 engage internally screw threaded bosses 30 fixed in and about casing 14. The radially inner end portions of rods 22 extend to connect via ball joints 32, to respective segments 34, only one of which is shown in FIG. 2, but a set of which forms an annular turbine stage liner, as depicted in FIG. 4. A stage of turbine blades 36, only one of which is shown, extend towards, but stop short of the radially inner surface of respective liner segments 34.

The gas turbine engine depicted and described herein, can be used to power an aircraft (not shown). During such use, engine 10 experiences a variety of temperatures and speeds of revolution of the rotating parts, as the aircraft taxies to the runway, takes off and climbs to cruise height. The highest temperatures, speed of revolution, and greatest extension of blades 36 occur during the take off run and climb of the associated aircraft. During these regimes, engine thrust is at maximum. It is thus essential to move liner segments 34 radially outwards from the seal fins 38 on the outer ends of blades 36, so as to avoid, or at worst, much reduce, rubbing contact therebetween.

In the present example, movement of segments 34 is achieved by electrical circuitry, illustrated diagrammatically and numbered 40, that notes change in capacitance between the segments 34 and blade fins 38, the change being brought about by change in their spacing. Thus, on blades 36 extending their lengths towards segments 34, the capacitance will change and so generate a signal in circuit 42, which signal is passed to rams 23 to actuate them so as to rotate unison ring 18 in a direction that will in turn, rotate links 20. Links 20 will transmit the rotary movement to rods 22, which will screw through their respective bosses 30 in a direction radially outwardly of the axis of engine 10, thus lifting their respective segments 34 away from blade fins 38.

When blades 36 contract away from segments 34, the reverse change in capacitance will be noted, and a signal generated and passed to rams 23 to achieve reverse rotation of unison ring 18, links 20 and rods 22, thus causing segments 34 to follow blades 36 towards the engine axis.

Figure 3:
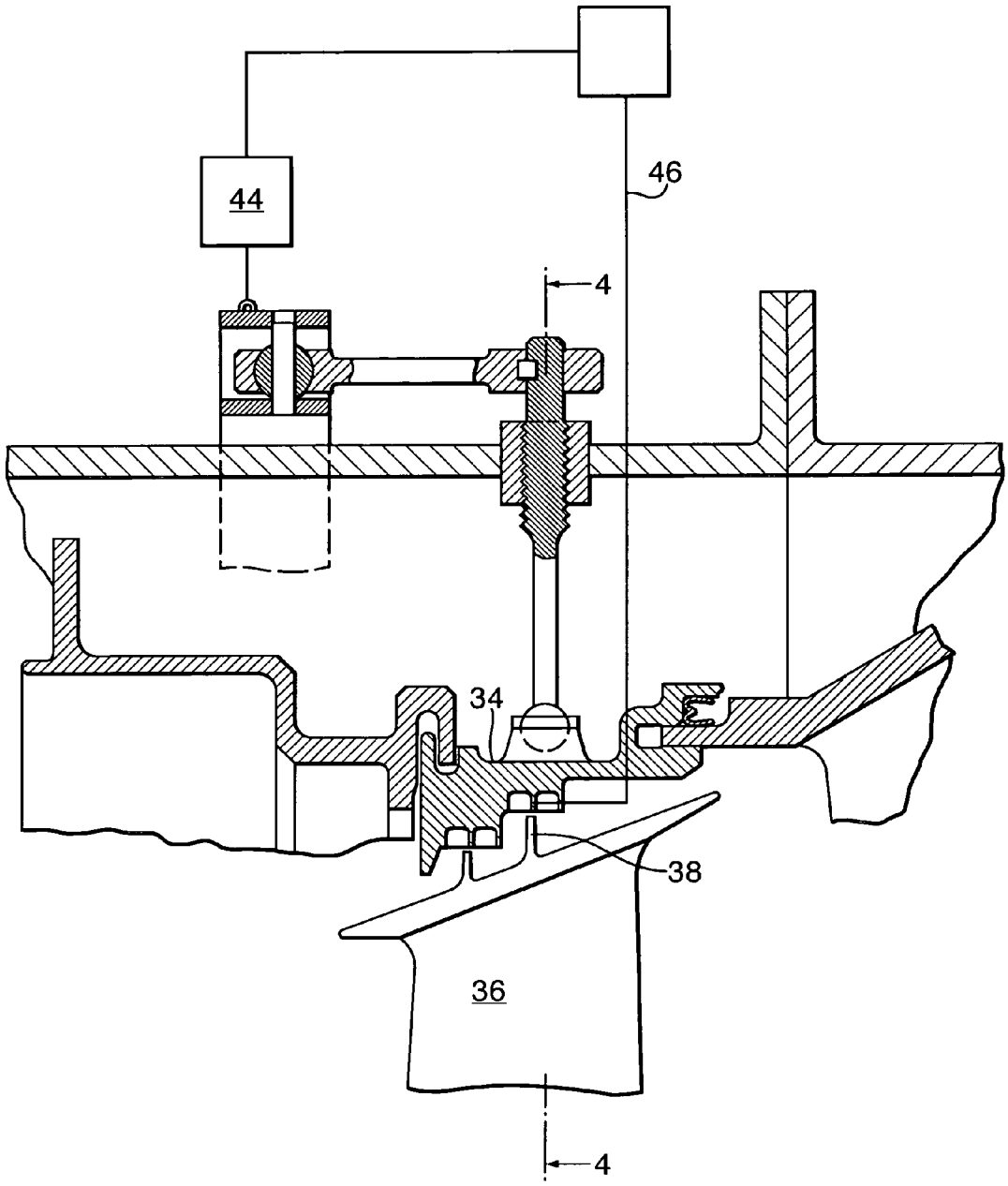
FIG. 3 is as FIG. 2 plus means to achieve differential movement of the segments.

Referring now to FIG. 3. In this example of the present invention, provision is made for moving diametrically opposing segments 34 in the same direction at the same time, so as to cater for very small ranges of eccentric rotation of the turbine stage. By "small" is meant the bearing supporting structure that limits displacement of the shaft (not shown) on which the turbine stage is mounted, (not shown), when the associated aircraft changes direction. By "same direction" is meant when one segment 34 needs to move radially outwards, the diametrically opposed segment 34 needs to be moved radially inwards. This is achieved by providing further rams 44, and connecting them to unison ring 18 and a capacitance sensing circuit 46, so as to enable its movement bodily in directions radial to the axis of engine 10, as in FIG. 4.

Referring now to FIG. 4. During operation of engine 10 (FIG. 1) the associated aircraft (not shown) is turning to the left as viewed in the drawing. The inertia of the turbine shaft (not shown) has caused it to lag behind the fixed casing structure 14 which follows the change in flight direction of the aircraft. Thus, momentarily, the axis of rotation of the shaft and therefor, the turbine stage, has, effectively, moved from position 64 to position 66. It must be emphasised here, that the axis displacement is much exaggerated for reasons of clarity, and FIG. 4 is a "frozen view" during shaft rotation.

The effective displacement of the turbine shaft (not shown) has brought the blade fins 38 on the right hand side of the turbine stage as viewed in FIG. 4, closer to the liner segments 34 on that side. Conversely, the blade fins on the left-hand side of the turbine stage are more widely spaced from opposing segments 34. The resulting changes in capacitance will cause ram 44*a* to move unison ring 18 bodily in an upward direction as indicated by arrow "A".

Briefly referring back to FIG. 2. The ball joint in each link consists of a ball 46 having a spindle 48 fixed in, and projecting out of the top and bottom of the ball. The ends of the spindles 48 are a sliding fit in respective opposing bores 50 in unison ring 18. Spindles 48 could of course, be fixed by their ends in respective bores 50, and be a sliding fit in balls 46. With either arrangement, by virtue of the sliding action, the bodily movement of unison ring 18 in the upward direction will not apply a bending force on associated top and bottom links 20, or cause them to apply a turning force on associated rods 22. The consequence of this is that top and bottom segments 34 will not move.

The bodily lifting of unison ring 18 will exert a small turning load on the links 20 associated with rods 22*b*, 22*d*, 22*h* and 22*f*, and therefor will turn those rods, this by virtue of the angular relationship between the vertically upward load and the axis of the respective links 20. Rods 22*b*, 22*d*, will move their respective segments 34 a small distance away from blade fins 38 that are in radial alignment with, and rods 22*f* and 22*h* will move their respective segments closer to blade fins that are in radial alignment with them. Links 20 connected to rods 22*c* and 22*g* will be rotated further, because the bodily lifting of unison ring 18 occurs in the plane of rotation thereof. Thus, the segment 34 connected to rod 22*c* will be moved a greater distance away from adjacent radially aligned blade fins 38, and the segment 34 connected to rod 22*g* will be moved a greater distance closer to adjacent radially aligned blade fins 38.

It is seen from the immediately foregoing description, that as the turbine stage rotates off axis when the associated aircraft (not shown) changes course, each ram 44 in turn, will apply the force to unison ring 18, to achieve bodily movement thereof in a direction at a right angle to the plane of maximum displacement of the turbine stage. By this means, rubbing of the blade fins on the surrounding segments is reduced to an absolute minimum.

I claim:

1. An assembly including a segmented turbine liner movably supported by and within a turbine casing including structure, the assembly comprising:

sensing means to sense the proximity of the segments of said liner to turbine blade tips during operational rotation of a stage of said blades within said casing structure;

signal generating means connected to said sensing means;

segment moving means connected to receive and be activated by signals generated by said signal generating means, so as to move as appropriate, any segments that said signals indicate are incorrectly spaced from respective blade tips, wherein said segment moving means includes a plurality of rotatable rods projecting both inward and outward of said casing structure, their inner ends being connected to respective segments, and their outer ends each being connected to the ends of respective links that are aligned axially of said casing structure, the other ends of said links being connected to a unison ring surrounding said casing structure; and rams connected between said signal generating means and said unison ring, the connection with said unison ring being such that on receipt of signals from said signal generating means, said rams move said unison ring bodily in a direction diametrically of said casing structure, to achieve via said links and rods, a desired movement in a common direction, of all segments except those opposing segments lying on the diametrical line of the applied force.

2. The segmented turbine liner of claim 1 wherein said sensing means comprises electrical circuitry to sense capacitance values between said segments and said blade tips.

3. The segmented turbine liner of claim 1 wherein said signal generating means comprises electrical circuitry connected to receive a capacitance output from said sensing means and to generate signals to activate said segment moving means based on the capacitance received from said sensing means.

4. The segmented turbine liner of claim 1 wherein said rods have screw threaded mid portions that engage screw threaded bosses in said casing structure, so that rotation of said rods causes said rods and their associated segments to move, depending on the rods direction of rotation, inward toward or outward from the blade tips of a turbine stage when associated therewith, depending on the rods direction of rotation.

5. The segmented turbine liner of claim 1 wherein said rams cause said unison ring to rotate about the axis of said casing structure, which said rotational movement is transferred via said links to said rods.

6. A gas turbine engine including a segmented turbine liner as claimed in claim 1.

7. The segmented turbine liner of claim 1, wherein the unison ring surrounds said casing structure and is connected via ball joints and links to a respective corresponding number of screw threaded rods that are equi-angularly spaced around said casing structure.

8. The segmented turbine liner of claim 1, wherein said rams apply force to the unison ring to achieve bodily movement thereof in a direction at a right angle to the plane of maximum displacement of the turbine stage.

* * * * *